US009493859B2

(12) United States Patent
Gao et al.

(10) Patent No.: US 9,493,859 B2
(45) Date of Patent: Nov. 15, 2016

(54) MANUFACTURING METHOD OF COPPER ALLOY SHEET

(71) Applicant: DOWA METALTECH CO., LTD., Tokyo (JP)

(72) Inventors: Weilin Gao, Tokyo (JP); Akira Sugawara, Tokyo (JP); Ryosuke Miyahara, Tokyo (JP); Hisashi Suda, Tokyo (JP)

(73) Assignee: DOWA METALTECH CO., LTD., Tokyo (JP)

( * ) Notice: Subject to any disclaimer, the term of this patent is extended or adjusted under 35 U.S.C. 154(b) by 134 days.

(21) Appl. No.: 14/528,311

(22) Filed: Oct. 30, 2014

(65) Prior Publication Data

US 2015/0053314 A1 Feb. 26, 2015

Related U.S. Application Data

(62) Division of application No. 12/805,055, filed on Jul. 9, 2010, now Pat. No. 8,992,702.

(30) Foreign Application Priority Data

Apr. 5, 2010 (JP) ..... 2010-087120
May 31, 2010 (JP) ..... 2010-123756

(51) Int. Cl.

| | |
|---|---|
| ***C22C 9/06*** | (2006.01) |
| ***C22C 9/10*** | (2006.01) |
| ***C22F 1/08*** | (2006.01) |
| ***H01B 1/02*** | (2006.01) |

(52) U.S. Cl.
CPC . *C22C 9/06* (2013.01); *C22C 9/10* (2013.01); *C22F 1/08* (2013.01); *H01B 1/026* (2013.01)

(58) Field of Classification Search
CPC ..... C22C 9/06; C22C 9/10; C22F 1/08
USPC ..... 148/554, 682
See application file for complete search history.

(56) References Cited

U.S. PATENT DOCUMENTS 5,675,883 A * 10/1997 Gaag et al. ..... 29/527.7

FOREIGN PATENT DOCUMENTS

| | | | |
|---|---|---|---|
| JP | 2006-152392 | A | 6/2006 |
| JP | 2007-169765 | A | 7/2007 |
| JP | 2008-106356 | A | 5/2008 |
| JP | 2008-248333 | A | 10/2008 |
| JP | 2009-007666 | A | 1/2009 |
| JP | 2009/123140 | A | 10/2009 |

OTHER PUBLICATIONS

Extended European Search Report issued Sep. 21, 2011 issued in corresponding European Application No. 10 00 7023.

* cited by examiner

*Primary Examiner* — Sikyin Ip
(74) *Attorney, Agent, or Firm* — Michael Best & Friedrich LLP

(57) ABSTRACT

Manufacturing method of a copper alloy sheet including melting and casting a raw material of a copper alloy having a composition containing 1.0 mass % to 3.5 mass % Ni, 0.5 mass % to 2.0 mass % Co, and 0.3 mass % to 1.5 mass % Si with a balance being composed of Cu and an unavoidable impurity. The method includes the steps of first cold rolling, intermediate annealing, second cold rolling, a solution heat treatment and aging. The solution heat treatment includes: heating at 800° C. to 1020° C.; first quenching to 500° C. to 800° C.; maintaining the 500° C. to 800° C. temperature for 10 seconds to 600 seconds; and second quenching to 300° C. or lower.

6 Claims, 3 Drawing Sheets

MANUFACTURING METHOD OF COPPER ALLOY SHEET

CROSS REFERENCE TO RELATED APPLICATION

This is a divisional of U.S. application Ser. No. 12/805,055 filed on Jul. 9, 2010, now U.S. Pat. No. 8,992,702, the contents of which, including specification, claims and drawings, are incorporated herein by reference in their entirety.

BACKGROUND OF INVENTION

1. Field of the Invention

The present invention relates to a copper alloy sheet that is suitable for electric/electronic components such as a connector, a lead frame, a relay, and a switch and that has excellent bending workability and stress relaxation resistance while maintaining high strength and good conductivity, a manufacturing method of the same, and an electric/electronic component using the same.

2. Description of the Related Art

Materials that are used in electric/electronic components as conductive components of a connector, a lead frame, a relay, a switch, and so on are required to have good conductivity in order to prevent Joule heat from being generated when electricity is supplied, and also is required to have high strength capable of resisting a stress given at the time of the assembly and operation of electric/electronic devices. Further, electric/electronic components such as a connector are required to have excellent bending workability since they are generally formed by bending after press punching, Further, as electric/electronic components have recently come to be used more under a severe environment, a demand for their stress relaxation resistance is also becoming severer. For example, when they are used under an environment where they are exposed to high temperature as is the case with an in-vehicle connector, stress relaxation resistance is especially important. Stress relaxation is a kind of a creep phenomenon that a contact pressure of a spring portion of a material forming an electric/electronic component decreases with time under a relatively high-temperature environment (for example, 100° C.; to 200° C.) even though being kept constant at room temperature. That is, it is a phenomenon that, while a metal material is in a state of being given a stress, a dislocation moves due to the self-diffusion of atoms forming a matrix and the diffusion of solid solution atoms, and plastic deformation occurs to relax the given stress.

Especially in recent years, electric/electronic components such as a connector are on a trend toward smaller size and lighter weight, which has created an increasing demand for a thinner copper alloy sheet as a material such as a sheet having a thickness of 0.15 mm or less or further 0.10 mm or less. Therefore, strength level required of the material is becoming still severer. Concretely, strength level equivalent to 0.2% proof stress of 850 MPa or more, preferably 900 MPa or more, and still more preferably 950 MPa or more is desired.

Further, electric/electronic components such as a connector are on a trend for higher integration, higher-density mounting, and larger current, and accordingly, higher conductivity is more required of material sheets made of copper or a copper alloy. Concretely, conductivity level equivalent to 30% IACS or more, preferably 35% IACS or more is desired while 0.2% stress proof of 900 MPa or more is maintained.

High-strength copper alloys conventionally used include a Cu—Be based alloy (for example, C17200 (Cu-2 mass % Be)), a Cu—Ti based copper alloy (for example, C19900 (Cu-3.2 mass % Ti)), a Cu—Ni—Sn based copper alloy (for example, C72700 (Cu-9 mass % Ni-6 mass % Sit)).

However, in view of cost and environmental load, there is a tendency in recent years to avoid using a Cu—Be based alloy. Further, a Cu—Ti based copper alloy and a Cu—Ni—Sn based copper alloy have a modulated structure (spinodal structure) in which a solid solution element has a cyclic concentration fluctuation in a parent phase, and have a property of having low conductivity of about 10% to 15% IACS, though having high strength.

A Cu—Ni—Si based alloy has been drawing attention as a material relatively excellent in property balance between strength and conductivity. For example, a Cu—Ni—Si based copper alloy sheet can have 0.2% proof stress of 700 MPa or more while maintaining relatively high conductivity of about 30% to about 50% IACS by going through processes basically of solution heat treatment, cold rolling, aging, finish cold rolling, and low-temperature annealing. However, it is a general knowledge that in the Cu—Ni—Si based alloy sheet, it is difficult to achieve higher strength such as 0.2% proof stress of 900 MPa or more, for instance.

As a measure to achieve higher strength in the Cu—Ni—Si based copper alloy sheet, there has been known commonly used methods such as the addition of large amounts of Ni and Si and an increase in a rolling ratio of the finish rolling (thermal refining) after the aging.

However, though strength increases in accordance with the increase in the addition amounts of Ni and Si, when the amounts reach certain values, for example, when an amount of Ni reaches 3 mass % and an amount of Si reaches about 0.7 mass % or more, the increase in strength tends to saturate and it is difficult to achieve 0.2% proof stress of 900 MPa or more. Further, adding excessive amounts of Ni and Si is accompanied by deterioration in conductivity and tends to make an Ni—Si based precipitate coarser; so that bending workability is likely to deteriorate. The increase in the finish rolling ratio after the aging can improve strength but is accompanied by great deterioration in bending workability of the copper alloy sheet, especially in workability at the time of bending where a rolling direction is along a bend axis (what is called Bad Way bend).

Due to the above, there is some case where a sheet having strength level high enough to achieve, for example, 0.2% proof stress of 900 MPa or more cannot be worked into an electric/electronic component.

In recent years, with the intention of achieving higher strength of a Cu—Ni—Si based copper alloy sheet, Japanese Patent Application Laid-open No. 2007-169765, Japanese Patent Application Laid-open No. 2008-248333, Japanese Patent Application Laid-open No. 2009-007666, and so on, for instance, propose a copper alloy sheet to which a relatively large amount of Co (for example, 0.5 to 2.0 mass % Co or more) is added, that is, what is called a Cu—Ni—Co—Si based copper alloy. Further, with the intention of improving bending workability, Japanese Patent Application Laid-open No. 2008-106356, International Publication WO2009-123140, and so on, for instance, propose a copper alloy in which an amount of twins present (the number of twin boundaries included in crystal grains) is controlled.

SUMMARY OF THE INVENTION

As is well known, a Cu—Ni—Si based copper alloy and a Cu—Co—Si based copper alloy both have their own merits and demerits. As for the Cu—Ni—Si based copper alloy, if it is subjected to rolling in addition to the precipitation in order to improve strength, it can easily have improved strength owing to work hardening and has excellent stress relaxation resistance. However, since the strengthening by the work hardening is likely to cause deterioration in bending workability, it is a general practice that a rolling ratio is lowered as much as possible. On the other hand, even with the same amount of an alloy element as that of the Cu—Ni—Si based copper alloy, the Cu—Co—Si based copper alloy has relatively high strength when its Co—Si based compound is precipitated after aging, but has a drawback that, when it is further rolled, a work hardening ratio is low even though deterioration in bending workability is small, and it is difficult to further improve strength. Further, it tends to be poorer in stress relaxation resistance than the Cu—Ni—Si based copper alloy.

Therefore, if the precipitation of a Ni—Si based compound and the precipitation of a Co—Si based compound can be appropriately controlled in a Cu—Ni—Co—Si based copper alloy, it is highly possible that strength, bending workability, and stress relaxation resistance improve at the same time.

However, a difference between an optimum aging temperature of the Ni—Si based compound and an optimum precipitation temperature of the Co—Si based compound makes it difficult to achieve optimum conditions for precipitating these two kinds of compounds at the same time.

The optimum aging temperature of the Ni—Si based compound is around 450° C. (generally, 425° C. to 475° C.), and if the aging temperature is too high, what is called an overaging state is produced, so that peak hardness lowers and an Ni—Si based precipitate tends to be coarse. If the aging temperature is too low, the precipitate does not become coarse because a precipitation speed is low, but there is a possibility that the precipitate is generated slowly or is not generated.

On the other hand, the optimum precipitation temperature of the Co—Si—based compound is higher than that of the Ni—Si based compound and is around 520° C. (generally 500° C. to 550° C.), Therefore, when the Cu—Ni—Co—Si based copper alloy undergoes the aging at a temperature around 450° C., a precipitation amount of the Co—Si based compound is small, and when it undergoes the aging at a temperature around 520° C., the Ni—Si based precipitate becomes coarse. In neither case, the two kinds of precipitates can be used at the same time. Further, even with the aging at an intermediate temperature, for example, 480° C., it is difficult to achieve the optimum states of the two kinds of precipitates at the same time. That is, in the aging divided into three stages of subaging—peak aging—overaging, if the aging time is short, an amount of the Co—Si based precipitate is still small when the Ni—Si based precipitate is in the peak aging. If the aging time is longer, when the Co—Si based precipitate reaches the peak aging, the Ni—Si based precipitate becomes coarse and does not contribute to the strength.

Japanese Patent Application Laid-open No. 2007-169765 discloses a Cu—Ni—Co—Si based copper alloy whose property is improved by controlling secondary phase density by reducing coarse precipitates. This copper alloy has relatively high conductivity of 41% IACS or more and is excellent in bending workability but its strength level is only 0.2% proof stress of 600 to 770 MPa.

Japanese Patent Application Laid-open No. 2008-248333 discloses a Cu—Ni—Co—Si based copper alloy having 0.2% proof stress of 810 to 920 MPa with its strength being improved not only by controlling the secondary phase density by reducing coarse precipitates as in Japanese Patent Application Laid-open No. 2007-169765 but also by combining work hardening. However, in order to reduce the coarse precipitates, a finish temperature of hot rolling needs to be 850° C. or higher, which is difficult to realize in view of cost in a common industrial hot rolling facility. Further, it is difficult to obtain a stress relaxation property on a level high enough to allow its use in an in-vehicle connector or the like.

Japanese Patent Application Laid-open No. 2009-007666 discloses a Cu—Ni—Co—Si based copper alloy whose property is improved by controlling an average crystal grain size and a texture, but its strength level is such that 0.2% proof stress is 652 to 862 MPa and does not reach 900 MPa or more.

Meanwhile, recent studies have made it clear that the larger an amount of twins present in a polycrystalline metal (the number of twin boundaries included in a crystal grain), the more advantageous for bending workability, stress relaxation resistance, and the like, but currently, little has been known, both theoretically and experimentally, about a method of controlling an amount of the twins present.

Both in Japanese Patent Application Laid-open No. 2008-106356 and International Publication WO2009-123140, though their measuring methods of an amount of twins present are different, an average number of twin boundaries per crystal grain is about 1 to 3 at largest and strength level is such that tensile strength is 600 to 830 MPa, and thus only a limited effect of property improvement is produced. Further, International Publication WO2009-123140 describes that heat treatment by high-temperature annealing is necessary to increase the density of twin boundaries, but as a result, crystal grains become coarse, resulting in poor bending workability.

Therefore, because of the reasons that the optimum precipitation temperature and time of the Ni—Si based component are not equal to (different from) those of the Co—Si based component and the mechanism of how the twin is generated is not known, it is not possible to make full use of the two kinds of precipitates at the same time in a publicly-known manufacturing method, and the control for producing the texture having high-density twins and an appropriate crystal grain size is not possible. This has made it difficult to achieve high strength together with excellent bending workability and stress relaxation resistance at the same time.

In view of the above conventional problems, it is an object of the present invention to provide a copper alloy sheet having high conductivity, high strength, and excellent bending workability and at the same time having stress relaxation resistance responsible for reliability in a severe use environment such as an in-vehicle connector and to provide a manufacturing method of the same.

The present inventors have confirmed that in a Cu—Ni—Co—Si based copper alloy, precipitates mainly include two kinds of Ni—Si based and Co—Si based compounds and in addition include a small amount of an Ni—Co—Si based compound, and have found a method capable of controlling the two kinds of Ni—Si based and Co—Si based precipitates. Further, it has been found out that by increasing the density of twin boundaries inside a crystal grain, it is possible to improve both a stress relaxation property and bending workability. Further, by increasing a ratio of crystal grains with {100}orientation (Cube orientation) having low anisotropy, it is possible to improve bending workability and also remarkably improve anisotropy of bending workability. The inventors have found out that these measures can achieve high strength and can further achieve a remarkable improvement in a stress relaxation property, bending workability, and anisotropy thereof at the same time while maintaining high conductivity, and eventually have completed the present invention.

That is, a copper alloy sheet according to the present invention is a copper alloy sheet including 1.0 mass % to 3.5 mass % Ni, 0.5 mass % to 2.0 mass % Co, and 0.3 mass % to 1.5 mass % Si, a Co/Ni mass ratio being 0.15 to 1.5, an (Ni+Co)/Si mass ratio being 4 to 7, and a balance being composed of Cu and an unavoidable impurity, wherein in observation results of a crystal grain boundary property and crystal orientation by EBSP measurement, a density of twin boundaries among all crystal grain boundaries is 40% or more and an area ratio of crystal grains with Cube orientation is 20% or more, on a rolled surface.

A manufacturing method of a copper alloy sheet according to another aspect of the present invention includes: a melting/casting step of melting and casting a raw material of a copper alloy having a composition containing 1.0 to 3.5 mass % Ni, 0.5 to 2.0 mass % Co, and 0.3 to 1.5 mass % Si with a balance being composed of Cu and an unavoidable impurity; a hot rolling step of performing hot rolling after the melting/casting step; a first cold rolling step of performing cold rolling after the hot rolling step; an intermediate annealing step of performing heat treatment at a heating temperature of 500° C. to 650° C. after the first cold rolling step; a second cold roiling step of performing cold rolling with a rolling ratio of 70% or more after the intermediate annealing step; a solution heat treatment step of performing solution heat treatment after the second cold rolling step; and an aging step of performing aging at 400° C. to 500° C. after the solution heat treatment step, wherein the solution heat treatment step includes: a heating step at 800° C. to 1020° C.; a first quenching step of performing quenching to 500° C. to 800° C. after the heating step; a temperature maintaining step of maintaining the 500° C. to 800° C. temperature for 10 to 600 seconds; and a second quenching step of performing quenching to 300° C. or lower after the temperature maintaining step.

Furthermore, the present invention provides an electric/electronic component using the copper alloy sheet as a material.

According to the present invention, it is possible to realize a copper alloy sheet that has excellent bending workability and stress relaxation resistance at the same time while maintaining high conductivity and high strength, and an electric/electronic component using the same.

DETAILED DESCRIPTION OF THE INVENTION

Figure 1:
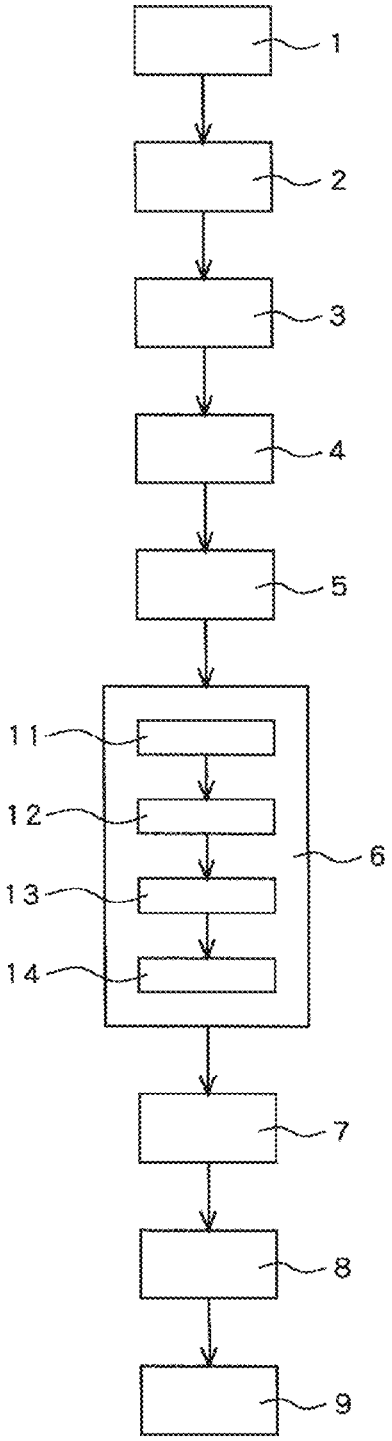
FIG. 1 is a block chart showing steps of a manufacturing method of the present invention.

A copper alloy sheet of the present invention contains 1.0 to 3.5 mass % Ni, 0.5 to 2.0 mass % Co, and 0.3 to 1.5 mass % Si, and its Co/Ni mass ratio is 0.15 to 1.5, its (Ni+Co)/Si mass ratio is 4 to 7, and the balance is composed of Cu and an unavoidable impurity. Further, in observation results of a crystal grain boundary property and crystal orientation by EBSP measurement, a density of twin boundaries (Σ3 coincidence site lattice boundaries) among all crystal grain boundaries is 40% or more and an area ratio of crystal grains with Cube orientation is 20% or more, on a rolled surface of the copper alloy sheet.

This copper alloy sheet further contains at least one kind or more of Fe, Cr, Mg, Mn, Ti, V, Zr Sn, Zn, Al, B, P, Ag, Be and misch metal totally in a 2 mass % or less range, when necessary.

Hereinafter, the copper alloy sheet and a manufacturing method of the same will be described in detail.

First, the alloy composition will be described. A copper alloy of the present invention is a Cu—Ni—Co—Si based copper alloy, It should be noted that in this specification, copper alloys in which Sn, Zn, Mg, Fe, Cr, Mn, Ti, V, Zr, or other alloy element is added to Cu—Ni—Co—Si base components will be also comprehensively called a Cu—Ni—Co—Si based copper alloy.

Ni forms an Ni—Si based precipitate and has an effect of improving strength and conductivity of the copper alloy sheet. When the Ni content is less than 1.0 mass %, it is difficult to sufficiently exhibit this effect. Therefore, the Ni content is preferably 1.0 mass % or more, more preferably 1.5 mass % or more, and still more preferably 2.0 mass % or more. On the other hand, when the Ni content is too high, the strength improving effect saturates and moreover conductivity lowers. Further, a coarse precipitate is likely to be generated, which will be a cause of a fracture at the time of bending work. Therefore, the Ni content is preferably 3.5 mass % or less and more preferably 3.0 mass % or less.

Co forms a Co—Si based precipitate and has an effect of improving strength and conductivity of the copper alloy sheet. In particular, it has an effect of dispersing the Ni—Si based precipitate, and consequently, the coexistence of the two kinds of precipitates produces a synergistic effect of improving strength. In order to have these effects fully exhibited, it is desirable to ensure that the Co content is 0.5 mass % or more. However, since a melting point of Co is higher than that of Ni, if its content is 2.0 mass % or more, complete solid solution is difficult and a part not solid-dissolved does not contribute to strength. Further, in order to have the synergistic effect of strength improvement by the coexistence of the two kinds of precipitates exhibited, a mass ratio Co/Ni between Co and Ni is preferably 0.15 to 1.5 and more preferably 0.2 to 1.0. Therefore, the Co content is still more preferably adjusted within a 0.5 to 1.5 mass % range.

From Si, an Ni—Si based precipitate and a Co—Si based precipitate are generated. It is thought that the Ni—Si based precipitate is a compound mainly made of $Ni_2Si$, and the Co—Si based precipitate is in the form of $Co_2Si$. However, through aging, Ni, Co, and Si in the alloy do not all turn into the precipitates, and some of them exist in a solid-solution state in a Cu matrix. Ni, Co, and Si in the solid-solution state slightly improve strength of the copper alloy sheet but in this state, exhibit this effect to a smaller degree than in the precipitated state and will be a cause of lowering conductivity. Therefore, it is generally preferable that the Si content is as close to a composition ratio of the precipitates $Ni_2Si$ and $Co_2Si$ as possible. That is, the (Ni+Co)/Si mass ratio is generally adjusted to 3 to 5 around about 4.2.

However, as a result of detailed studies on an influence that the (Ni+Co)/Si mass ratio has on properties of the Cu—Ni—Co—Si based copper alloy, the present inventors have found out that, when the (Ni+Co)/Si mass ratio falls within a 3 to 7 range, final strength and conductivity do not change much but the density of twins and texture greatly change. It has been further found out that an excessive amount of Si lowers the density of twins and an area ratio of grains with Cube orientation. That is, it is necessary to adjust the Si content so that the (Ni+Co)/Si mass ratio falls within a range of 4 to 7, preferably 4.0 to 6.5, and still more preferably 4.2 to 5.5. Therefore, the Si content preferably falls within a 0.3 to 1.5 mass % range and more preferably within a 0.5 to 1.2 mass % range.

When necessary, elements such as Fe, Cr, Mg, Mn, Ti, V, Zr, Sn, Zn, Al, B, P, Ag, or Be, misch metal, and so on may be added to the copper alloy sheet of the present invention. For example, Sn and Mg have an effect of improving stress relaxation resistance, Zn has an effect of improving solderability and castability of the copper alloy sheet, and Fe, Cr, Mn, Ti, V, Zr, and so on have an effect of improving strength. In addition, Ag has an effect of solid-solution hardening without lowering conductivity greatly. P has a deoxidation effect, and B has an effect of producing a fine cast structure and has an effect of improving hot rolling workability. Further, misch metal, which is a mixture of rare earth elements including Ce, La, Dy, Nd, and Y, has an effect of producing fine crystal grains and an effect of dispersing the precipitates.

When the copper alloy sheet contains one kind of more of Fe, Cr, Mg, Mn, Ti, V, Zr, Sn, Zn, Al, B, P, Ag, Be, and misch metal, it is preferable that a total amount of these elements is 0.01 mass % or more in order to fully achieve the effects produced by the addition of these elements. However, the total amount over 2 mass % not only causes deterioration in conductivity and deterioration in hot rolling workability or cold rolling workability, but also is disadvantageous in view of cost. Therefore, the total amount of these elements is 2 mass % or less, preferably 1 mass % or less, and more preferably 0.5 mass % or less.

Next, a twin boundary will be described. A twin is a pair of adjacent crystal grains whose crystal lattices are in reflectional symmetry with respect to a certain plane (which is called a twin boundary and is generally a {111}plane). A most typical twin in copper or an copper alloy is a portion called a twin band sandwiched by two parallel twin boundaries in a crystal grain.

A property of a crystal grain boundary is measured based on atomic orientations of the adjacent crystal grains by an EBSP (Electron Back Scattering Pattern) method. A typical grain boundary is also called a random grain boundary since crystal lattice points of the respective crystal grains on its both sides do not have any coincidence relation. On the other hand, grain boundaries each sandwiched by two crystal grains that are in an orientation relation of sharing a certain ratio (expressed as a Σ value) of lattice points among their respective crystal lattice points are coincidence site lattice boundaries, and among them, a Σ3 coincidence site lattice boundary is a twin boundary.

The twin boundary is a grain boundary with the lowest grain boundary energy, and, as a grain boundary, sometimes plays a full role of improving bending workability, but compared with typical grain boundaries, its properties are such that it has a precise structure with little disorderly atomic arrangement along the boundary, makes the diffusion of atoms, the segregation of impurities, and the formation of the precipitates difficult, and breakage does not easily occur along the boundary. That is, the larger the number of the twin boundaries, the more advantageous in improving stress relaxation property and bending workability.

The density (frequency) of the twin boundaries can be calculated by "sum of lengths of Σ3 coincidence site lattice boundaries)/(sum of lengths of crystal grain boundaries)× 100%. The density of the twin boundaries is preferably 40% or more, more preferably over 50%, and still more preferably 60% or more.

The mechanism of how the twin boundary is formed has not been clear yet, but from the research by the present inventors, it has been found out that this is influenced by an (Ni+Co)/Si mass ratio, an existence state (solid solution or precipitate) of alloy elements before solution heat treatment (recrystallization), a condition of the solution heat treatment, a finish rolling ratio, and the like.

The density of the twin boundaries of a copper alloy manufactured by a common manufacturing method is about 10% to about 20% (in optical microscopic texture, corresponding to a case where the average number of twin bands per crystal grain is about 0.5), while, in the present invention, later-described alloy composition and manufacturing condition make it possible to achieve 60% or more (corresponding to a case where the average number of twin bands per crystal grain is 3 or more).

Next, crystal orientation will be described. Cube orientation ({100} <001> orientation) presents similar properties in three directions, that is, a thickness direction ND of a rolled surface, a rolling direction LD, and a direction TD perpendicular to the rolling direction and is generally called Cube orientation. Further, the combination of a slip plane and a slip direction enabling both LD: <001> and TD: <010> to contribute to the slip comes in 8 patterns among 12 patterns, and Schmit factors of all of them are 0.41. Further, since a slip line on a {100}crystal plane can have good symmetry of 45° and 135° with respect to a bend axis, it has been found that bending deformation can occur without forming a shear zone. That is, the Cube orientation has a characteristic of not only achieving good bending workability both in Good Way and Bad Way and having no anisotropy.

Therefore, on a surface of the copper alloy sheet, a surface integral ratio of crystal grains having orientation whose orientation difference from {100} orientation is within 100 in an OIM (Orientation Imaging Microscopy) image which maps the crystal grain orientation distribution measured by an EBSP method is desirably 20% or more and more desirably 30% or more.

It is well known that the Cube orientation is main orientation of a pure copper-type recrystallized texture, but the Cube orientation is difficult to develop in a copper alloy under a common manufacturing conduction. However, in this invention, by combining an intermediate annealing step under a specific condition and an appropriate solution heat treatment condition as shown in the following manufacturing steps, it is possible to obtain a copper alloy sheet having crystal orientation with a high Cube orientation ratio.

The smaller an average crystal grain size, the more advantageous in improving bending workability, but too small an average crystal grain size is likely to lower a surface integral ratio of the Cube orientation and stress relaxation resistance. Further, a final average crystal grain size is almost decided by a crystal grain size at a stage after the solution heat treatment. Therefore, if the average crystal grain size is too small, solute elements are not fully dissolved after the solution heat treatment and final strength is highly likely to become low. Various studies have led to the findings that when an average crystal grain size in a normal sense which is finally measured by using a cutting method of JIS 110501, with twin boundaries excluded, is 3 μm or more, preferably 5 μm or more, and more preferably over 8 μm, stress relaxation resistance on a satisfactory level can be ensured even in the application to an in-vehicle connector, and thus this value is suitable. However, if the average crystal grain size is too large, a bent portion surface is likely to become rough and sometimes bending workability deteriorates, and therefore, the average crystal grain size is desirably within a range of 60 μm or less. The average crystal grain size is more preferably adjusted to a range of 8 to 20 μm. The final average crystal grain size is almost decided by the crystal grain size at the stage after the solution heat treatment. Therefore, the average crystal grain size can be controlled by the later-described solution heat treatment condition.

Next, properties of the copper alloy sheet will be described.

In order to downsize and thin an electric/electronic component such as a connector, 0.2% proof stress of a copper alloy sheet as a material is preferably 900 MPa or more, and more preferably 930 MPa or more. As for bending workability, a ratio R/t between the minimum bend radius R and a sheet thickness t in a 90° W bend test is preferably 2.0 or less and more preferably 1.5 or less, both in Good Way and Bad Way.

Further, an electric/electronic component such as a connector is on a trend toward higher integration, higher-density mounting, and larger current, which accordingly is creating an increasing demand for higher conductivity of a copper or copper-alloy sheet as a material. Concretely, 30% IACS or more is preferable, and more preferably, conductivity level of 35% IACS or more is desired.

As for stress relaxation resistance, since a value for TD is especially important in the application to an in-vehicle connector or the like, it is desirable that a stress relaxation property is evaluated based on a stress relaxation ratio by using a test piece whose longitudinal direction is TD. When the test piece is kept at 150° C. for 1000 hours in a state where the maximum load stress on a sheet surface is set to 80% of 0.2% proof stress, the stress relaxation ratio is preferably 7% or less and more preferably 5% or less.

Next, the manufacturing method of the copper alloy sheet according to the present invention will be described.

The copper alloy sheet having the above-described properties is manufactured by a manufacturing method of the copper alloy sheet of the present invention shown in FIG. 1. The manufacturing method of the copper alloy sheet according to the present invention includes: a melting/casting step 1 of melting and casting a raw material of a copper alloy having the above-described composition; a hot rolling step 2 performed after the melting/casting step 1; a first cold rolling step 3 of performing cold rolling with a rolling ratio of 70% or more after the hot-rolling step 2; an intermediate annealing step 4 of performing heat treatment at a heating temperature of 500° C. to 650° C. after the first cold rolling step 3; a second cold rolling step 5 of performing cold rolling at a rolling ratio of 70% or more after the intermediate annealing step 4; a solution heat treatment step 6 of performing solution heat treatment after the second cold rolling step 5; and an aging step 7 of performing aging at 400° C. to 500° C. after the solution heat treatment step 6.

Further, the solution heat treatment step 6 has: a heating step 11 of heating at 800° C. to 1020° C.; a first quenching step 12 of quenching to 500° C. to 800° C. after the heating step 11; a temperature maintaining step 13 of maintaining the 500° C. to 800° C. temperature for 10 to 600 seconds: and a second quenching step 14 of quenching to 300° C. or lower after the temperature maintaining step 13.

Note that, at the time of the intermediate annealing step 4, the 500° C. to 650° C. heat treatment is preferably continued for 0.1 to 20 hours so that the copper alloy sheet after the intermediate annealing satisfies conductivity of 40% IACS or more and Vickers hardness of HV150 or less.

Further, after the aging step 7, the method preferably has a finish cold rolling step 8 with a rolling ratio of 10% to 80%, and after the finish cold rolling step 8, the method preferably has a low-temperature annealing step 9 of performing heat treatment at 150° C. to 550° C. Further, after the hot rolling step 2, facing may be performed when necessary, and after the solution heat treatment step 6, acid cleaning, polishing, degreasing, and the like may be performed when necessary. Hereinafter, the respective steps will be described in more detail.

(Melting/casting step 1) By a method similar to a common melting method of a copper alloy, after a raw material of the copper alloy is melted, a cast slab is manufactured by continuous casting, semi-continuous casting, or the like. The melting/casting step 1 is preferably performed in an inert gas atmosphere or in a vacuum melting furnace in order to prevent oxidation of Si and Co.

(Hot rolling step 2) Hot rolling of the cast slab is performed in several separate passes while the temperature is decreased from 1000° C. to 500° C. A total rolling ratio can be about 80% to about 95%. After the completion of the hot rolling, quenching by water cooling is preferably performed. Further, after the hot rolling, facing and acid cleaning may be performed when necessary.

(First cold rolling step 3) In the first cold rolling step 3, a rolling ratio needs to be 70% or more and is more preferably 80% or more. In the next step, the material worked with such a rolling ratio is subjected to the intermediate annealing step 4, which can increase an amount of precipitates.

(Intermediate annealing step 4) Next, the intermediate annealing step 4 is performed for the purpose of precipitation. In a conventional manufacturing process of a copper alloy sheet, this intermediate annealing step is not performed or for the purpose of reducing a rolling load in the next step, high-temperature heat treatment is performed in order to soften or recrystallize the sheet. However, in any of these cases, the density of twin boundaries in a recrystallized crystal grain and the formation of a recrystallized texture whose main orientation component is the Cube orientation are insufficient after the solution heat treatment step.

As a result of detailed study and research by the present inventors, it has been found out that the formation of twins and Cube orientation in a recrystallization process is influenced by a stacking fault energy of a parent phase immediately before the recrystallization. The lower the stacking fault energy, the more easily an annealing twin is formed. On the contrary, the higher the stacking fault energy, the more easily the Cube orientation is formed. For example, the stacking fault energy is low in brass, pure copper, and pure aluminum in this order. In brass, though the density of annealing twins is low, the Cube orientation is not easily formed. On the other hand, in pure aluminum, the density of annealing twins is low though the Cube orientation is easily formed. On the other hand, in pure copper, the densities of the Cube orientations and the annealing twins are both relatively high. Therefore, in a precipitation-type copper alloy whose stacking fault energy is close to that of pure copper, it is highly possible that the densities of the annealing twins and the Cube orientations can both be high.

In order to cause the high-density generation of both the annealing twins and the Cube orientations, a solid-solution element amount is reduced by precipitating Ni, Co, Si, and the like in the intermediate annealing step 4. This can increase the stacking fault energy. When the intermediate annealing step 4 is performed at a temperature of 500° C. to 650° C. and the precipitation is caused by the aging whose heat treatment time is 0.1 to 20 hours, a good result can be obtained.

When the annealing temperature is too low or when the annealing time is too short, the full precipitation is not possible, a solid-solution element amount becomes high, so that the recovery of conductivity is not sufficient, and improvement in the stacking fault energy is small. When the annealing temperature is too high, solubility limit of the solid-solution element becomes high, and even if the annealing temperature is made longer, sufficient precipitation cannot be caused. In neither case, the high-density generation of both the annealing twins and the Cube orientations is possible. Concretely, the intermediate annealing step 4 is preferably performed so that conductivity satisfies 40% IACS or more and Vickers hardness satisfies HV150 or less after the intermediate annealing step 4.

(Second cold rolling step 5) Subsequently, the second cold rolling step 5 being the second cold rolling is performed. In the second cold rolling step 5, a rolling ratio is preferably 70% or more. In this second cold rolling step 5, due to the existence of the precipitates generated by the previous step, it is possible to introduce strain energy efficiently. When the strain energy is lacking, there is a possibility that the size of the recrystallized grains generated at the time of the solution heat treatment becomes uneven and the density of the twin boundaries and the formation of the recrystallized texture whose main orientation component is the Cube orientation are insufficient.

(Solution heat treatment step 6) Conventional solution heat treatment mainly aims at the solid-solution of a solute element into a matrix again and the recrystallization, but another important object in the present invention is to form high-density twins and form a recrystallized texture whose main orientation component is the Cube orientation.

In the solution heat treatment step 6, 800° C. to 1020° C. heat treatment for 10 to 600 seconds is preferably performed according to the components. When the temperature is too low, the recrystallization is incomplete and the solid solution of the solute element is also insufficient. Further, the density of the annealing twins and the component whose main orientation is the Cube orientation tend to decrease, and it is difficult to finally obtain a copper alloy sheet excellent in bending workability and high in strength. On the other hand, when the temperature is too high, the crystal grains become coarse and bending workability is likely to deteriorate.

Concretely, in the heating step 11 in the solution heat treatment step 6, the heat treatment is desirably performed by setting the holding time of the 800° C. to 1020° C. range and the ultimate temperature so that an average crystal grain size of the recrystallized grains (the twin boundaries are not regarded as crystal grain boundaries) becomes 3 to 60 μm, and it is more preferable that they are adjusted so that the average crystal grain size becomes 8 to 20 μm. When the re-crystallized grain size is too minute, the density of the annealing twins lowers. Further, this is also disadvantageous in improving stress relaxation resistance. When the re-crystallized grain size becomes too coarse, a surface of a bent portion is likely to be rough. The re-crystallized grain size varies depending on the cold rolling ratio and the chemical composition before the solution heat treatment, but by finding a relation between a solution heat treatment heat pattern and the average crystal grain size for each alloy by an experiment in advance, it is possible to set the holding time of the 800° C. to 1020° C. range and the ultimate temperature. Concretely, in the copper alloy with the chemical composition of the present invention, a heating condition that the temperature of 800° C. to 980° C. is held for 10 to 600 seconds can be set as a proper condition.

In the cooling after the aforesaid heating step 11 in the solution heat treatment step 6, in order to avoid the precipitation of a compound in the course of the cooling as much as possible, the quenching is generally performed in a manner that the temperature is quickly lowered to a temperature at which the precipitation does not occur. However, since the optimum precipitation temperatures and times of the Ni—Si based compound and the Co—Si based compound do not equal (are different) as previously described, it has not conventionally been possible to make a full use of the two kinds of precipitates, which is a reason why it is not possible to realize both high proof stress of 900 MPa or more at the same time with good bending workability and stress relaxation resistance while maintaining conductivity. Therefore, in the present invention, a cooling pattern used is such that after keeping a specific temperature range of the quenching process for a prescribed time, the quenching is performed again. That is, in the present invention, the cooling is performed in advance so that the precipitate of the Co—Si based compound becomes minute, at a temperature range at which little precipitation of the Ni—Si based compound occurs.

Concretely, the cooling pattern after the heating step 11 in which the heat treatment is performed at the heating temperature of 800° C. to 1020° C. is composed of: a first quenching step 12 of quenching to a 500° C. to 800° C. temperature range at a cooling speed of 10° C./s or more, preferably 50° C./s or more, and more preferably 100° C./s or more; a temperature maintaining step 13 of maintaining the 500° C. to 800° C. temperature range for 10 to 600 seconds after the first quenching step 12; and a second quenching step 14 of thereafter quenching again to 300° C. or lower at a cooling speed of 10° C./s or more, preferably 50° C./s or more, and more preferably 100° C./s or more. Note that the cooling speed of the first quenching step 12 is an average cooling speed when the temperature is lowered from the 800° C. to 1020° C. range to the 500° C. to 800° C. range which is the maintained temperature of the temperature maintaining step 12, and the cooling speed of the second quenching step 14 is an average cooling speed when the temperature is lowered from the 500° C. to 800° C. range, which is the maintained temperature of the temperature maintaining step 12, to 300° C. or lower. The temperature maintaining step 13 performed at 500° C. to 800° C. for 10 to 600 seconds is intended to generate the minute precipitates of the Co—Si based compound at a temperature range at which little precipitation of the Ni—Si based compound occurs. When the maintained temperature of the temperature maintaining step 13 is too high, a driving force for precipitating the Co—Si based compound decreases and the precipitates get fewer and are likely to be coarse. On the contrary, when the maintained temperature is too low, it takes a long time to precipitate the Co—Si based compound, and thus substantially no precipitation occurs, so that it is not possible to make full use of the two kinds of precipitates at the same time as in the conventional manufacturing method. That is, it is not possible to finally satisfy all of high proof stress of 900 MPa or more, good bending workability, and excellent stress relaxation resistance while keeping good conductivity. Further, if the holding time is too long, the Co—Si based precipitate is likely to be coarse, and when the holding time is too short, only a small amount of the Co—Si based precipitate is generated.

Concretely, for the copper alloy with the composition of the present invention, the proper condition of the temperature maintaining step 13 can be set such that the temperature of 500° C. to 800° C. is maintained for 10 to 600 seconds. More preferably, a temperature of 550° C. to 750° C. (or a temperature over 550° C. and equal to or lower than 750° C.) is maintained for 20 to 300 seconds, and still more preferably, for 50 to 300 seconds.

At the time of the first quenching step 12, if the quenching is performed to a temperature range higher than 800° C. and this temperature is maintained, the Co—Si based compound easily precipitates and the precipitate is likely to become coarse, and if the quenching is performed to a temperature range lower than 500° C. and this temperature is maintained, an amount of the precipitate of the Co—Si based compound is small. In nether case, it is possible to finally satisfy all of high proof stress, good bending workability, and excellent stress relaxation resistance.

The solution heat treatment step 6 is desirably performed in a series of flows in a continuous furnace in view of cost, but if there is a restriction of a facility or the like, the step can be divided in such a manner that the heating step 11 and the first quenching step 12 in which the quenching is performed to 300° C. or less after heating to 800° C. to 1020° C. are performed separately from the temperature maintaining step 13 of heating again and maintaining the 500° C. to 800° C. temperature for 10 to 600 seconds and the second quenching step 14 of quenching to 300° C. or lower. Further, when the step is divided into two steps, in order to further promote the precipitation of the Co—Si based compound, cold rolling with 50% or less may be interposed between them. However, since performing the heat treatment in a series of continuous flows enables texture control, it is desirable in view of cost that the step is performed in the continuous furnace.

Further, in order to promote the subsequent precipitation of the Ni—Si based compound, cold rolling with 50% or less may be performed after the second quenching step 14. However, after the heat treatment, a step of improving surface quality, such as acid cleaning and buffing is necessary before the rolling, which complicates the step and is disadvantageous in view of cost. In the manufacturing method of the present invention, the cold-rolling can be omitted owing to the later-described aging condition.

The solution heat treatment step 6 composed of the heating step 11, the first quenching step 12, the temperature maintaining step 13, and the second quenching step 14 described above can be performed in a solution heat treatment furnace composed of four zones, namely, a heating zone, a cooling zone, a temperature maintaining zone, and a cooling zone, which furnace is remodeled from a commonly used solution heat treatment furnace composed of a heating zone and a cooling zone. The residence times of the sheet in the heating zone and the temperature maintaining zone can be controlled by the adjustment of lengths of the zones and sheet passage speed. Further, a cooling speed in the cooling zone can be controlled by a rotation speed of a cooling fan. It should be noted that the cooling method is not limited to the above-described one, and may be any cooling method, such as water cooling, oil cooling, gas quenching, and cooling by salt bath, provided that the cooling speed can be controlled.

(Aging step 7) A main object of the aging step 7 performed next is to precipitate the Ni—Si based compound. When the aging temperature is too high, the Ni—Si based precipitate is likely to become coarse and at the same time the Co—Si based precipitate generated in the quenching step in the aforesaid solution heat treatment step 6 is also likely to become coarse. On the other hand, too low an aging temperature does not allow the full precipitation of the Ni—Si based compound and is also disadvantageous in view of productivity due to the need for increasing the aging time. Therefore, it is preferable to decide the condition according to the alloy composition by pre-adjusting the temperature and the time with which hardness reaches the peak by the aging. Concretely, a temperature of 400° C. to 500° C. is preferable and a temperature of 425° C. to 475° C. is more preferable. When the aging time is about 1 hour to about 10 hours, a good result is obtained.

(Finish cold rolling step 8) The finish cold rolling step 8 is important for improving strength level, especially for improving 0.2% proof stress. When a rolling ratio of the finish cold rolling is too low, the effect of increasing strength cannot be fully obtained. On the other hand, when the rolling ratio of the finish cold rolling is too high, bending workability in the TD direction may possibly deteriorate.

This rolling ratio of the finish cold rolling step 8 needs to be 10% or more, preferably 15% or more. However, an upper limit of the rolling ratio is desirably set to 80%, more desirably not greater than 60%. The final sheet thickness is preferably about 0.05 mm to about 1.0 mm, more preferably 0.08 mm to 0.5 mm though depending on the intended use of the sheet.

(Low-temperature annealing step 9) It is preferable to perform low-temperature annealing after the finish cold rolling step 8 in order to improve strength by low-temperature annealing hardening, reduce a residual stress of the sheet, and improve a spring limit value and stress relaxation resistance. The heating temperature is preferably set to 150° C. to 550° C. This reduces the residual stress inside the sheet and thus has an effect of improving conductivity. When the heating temperature is too high, softening occurs in a short time, and properties are likely to vary both in a batch type and a continuous type. On the other hand, when the heating temperature is too low, the aforesaid effect of improving properties cannot, be sufficiently obtained. The heating time is preferably 5 seconds or more, and a good result can be generally obtained within one hour.

Hereinafter, examples of the copper alloy sheet according to the present invention and manufacturing methods thereof will be described.

Raw materials with the compositions shown in Table 1 were melted and were cast by using a vertical semi-continuous casting machine, whereby cast slabs were obtained.

TABLE 1

| | chemical composition (mass %) | | | | | | |
|---|---|---|---|---|---|---|---|
| | Cu | Ni | Co | Si | others | Co/Ni | (Ni + Co)/Si |
| example 1 | balance | 2.52 | 1.16 | 0.76 | — | 0.46 | 4.8 |
| example 2 | balance | 2.85 | 1.03 | 0.84 | Mg: 0.04 | 0.36 | 4.6 |
| example 3 | balance | 3.28 | 0.59 | 0.88 | — | 0.18 | 4.4 |

TABLE 1-continued

| | chemical composition (mass %) | | | | | | |
|---|---|---|---|---|---|---|---|
| | Cu | Ni | Co | Si | others | Co/Ni | (Ni + Co)/Si |
| example 4 | balance | 1.69 | 1.52 | 0.62 | Fe: 0.04, Zn: 0.12 | 0.90 | 5.2 |
| example 5 | balance | 1.24 | 1.67 | 0.65 | Ti: 0.22, Sn: 0.05 | 1.35 | 4.5 |
| example 6 | balance | 2.46 | 1.36 | 0.66 | B: 0.003, Cr: 0.07 | 0.55 | 5.8 |
| example 7 | balance | 1.36 | 1.87 | 0.50 | Zr: 0.13 P: 0.005 | 1.38 | 6.4 |
| example 8 | balance | 2.87 | 1.12 | 0.81 | Mn: 0.05 | 0.39 | 4.9 |
| example 9 | balance | 2.54 | 0.95 | 0.74 | misch metal: 0.08 | 0.37 | 4.7 |
| example 10 | balance | 1.86 | 1.65 | 0.70 | Al: 0.15, Ag: 0.02 | 0.89 | 4.3 |
| example 11 | balance | 2.02 | 1.67 | 0.67 | V: 0.11 | 0.83 | 5.3 |
| example 12 | balance | 1.26 | 1.86 | 0.74 | — | 1.48 | 4.2 |
| example 13 | balance | 3.42 | 0.52 | 0.90 | — | 0.15 | 4.4 |
| comparative example 1 | balance | 2.53 | 1.17 | 0.97 | — | 0.46 | 3.8 |
| comparative example 2 | balance | 2.85 | 1.03 | 0.84 | Mg: 0.04 | 0.36 | 4.6 |
| comparative example 3 | balance | 2.85 | 1.03 | 0.84 | Mg: 0.04 | 0.36 | 4.6 |
| comparative example 4 | balance | 2.85 | 1.03 | 0.84 | Mg: 0.04 | 0.36 | 4.6 |
| comparative example 5 | Balance | 2.85 | 1.03 | 0.84 | Mg: 0.04 | 0.36 | 4.6 |
| comparative example 6 | balance | 1.46 | 2.46 | 0.82 | — | 1.68 | 4.8 |
| comparative example 7 | balance | 2.85 | 1.03 | 0.84 | Mg: 0.04 | 0.36 | 4.6 |
| comparative example 8 | balance | 1.80 | 1.50 | 0.81 | Cr: 0.21, Mg: 0.11 | 0.83 | 4.1 |

The respective cast slabs were heated to 980° C. and were hot-rolled while the temperature was lowered from 980° C. to 500° C. and were worked into sheets with a 10 mm thickness, and thereafter were quenched by water cooling (cooling speed of 10° C./s or more), and thereafter oxide layers of surface layers were removed by mechanical polishing (facing).

Next, they were subjected to the first cold rolling with a rolling ratio of 86%, and thereafter examples 1 to 13 to which the present invention was applied were subjected to the intermediate annealing at 500° C. to 640° C. for 3 to 8 hours. After the intermediate annealing, the examples 1 to 13 had conductivity of 40% to 57% IACS and hardness of HV96 to 148. Thereafter, they were subjected to the second cold rolling with a rolling ratio of 80% to 90%.

Next, they were kept at temperatures adjusted within a 860° C. to 1000° C. range according to the compositions of the alloys for one minute so that an average crystal grain size of each of them on a surface of the rolled sheet (by a cutting method of JIS H0501) became larger than 5 μm and equal to or less than 30 μm, and were subjected to the heat treatment of the solution heat treatment step. The temperature and time of the heat treatment were decided in such a manner that the optimum temperature and time were found according to the composition of the alloy of each of the examples by preliminary experiments.

Next, after the heat treatment, they were immersed in a salt bath to be quenched to a 700° C. temperature at a cooling speed of 15° C./s or more, were kept at the 700° C. temperature for 52 seconds, and thereafter were quenched (water cooling) to room temperature at a cooling speed of 50° C./s or more. Thereafter, the aging was performed at 450° C. for 2 to 4 hours. The aging time was adjusted to the time according to the alloy composition so that hardness reached the peak by the 450° C. aging.

Next, the finish cold rolling with a rolling ratio of 15% to 55% was performed and the low-temperature annealing was finally performed at 425° C. for one minute, whereby copper alloy sheets of the examples 1 to 13 were obtained. Incidentally, facing was performed in the course when necessary or the rolling ratio was adjusted to 80% to 90% in the second cold rolling step, so that the copper alloy sheets had an equal thickness of 0.15 mm. Manufacturing conditions are shown in TABLE 2.

TABLE 2

| | manufacturing condition | | | | | | |
|---|---|---|---|---|---|---|---|
| | intermediate annealing | | | | | | |
| | annealing condition | conductivity after annealing (% IACS) | hardness after annealing (HV) | heating condition of solution heat treatment | holding time at 700° C. (sec) | aging condition | finish rolling ratio (%) |
| example 1 | 550° C. × 6 h | 51.4 | 115 | 950° C. × 1 min | 52 | 450° C. × 2 h | 30 |
| example 2 | 600° C. × 8 h | 50.2 | 124 | 955° C. × 1 min | 52 | 450° C. × 3 h | 35 |
| example 3 | 550° C. × 8 h | 42.7 | 106 | 860° C. × 1 min | 52 | 450° C. × 4 h | 30 |
| example 4 | 570° C. × 6 h | 56.8 | 110 | 960° C. × 1 min | 52 | 450° C. × 2 h | 20 |
| example 5 | 550° C. × 6 h | 53.2 | 115 | 965° C. × 1 min | 52 | 450° C. × 4 h | 30 |
| example 6 | 550° C. × 6 h | 54.2 | 112 | 960° C. × 1 min | 52 | 450° C. × 3 h | 55 |
| example 7 | 570° C. × 6 h | 55.4 | 118 | 1000° C. × 1 min | 52 | 450° C. × 3 h | 35 |
| example 8 | 530° C. × 8 h | 49.4 | 121 | 945° C. × 1 min | 52 | 450° C. × 4 h | 30 |
| example 9 | 520° C. × 6 h | 50.4 | 109 | 925° C. × 1 min | 52 | 450° C. × 4 h | 30 |
| example 10 | 540° C. × 6 h | 52.6 | 107 | 975° C. × 1 min | 52 | 450° C. × 3 h | 20 |
| example 11 | 530° C. × 6 h | 51.2 | 131 | 950° C. × 1 min | 52 | 450° C. × 3 h | 15 |
| example 12 | 640° C. × 3 h | 40.3 | 96 | 1000° C. × 1 min | 52 | 450° C. × 2 h | 30 |
| example 13 | 500° C. × 6 h | 45.4 | 148 | 900° C. × 1 min | 52 | 450° C. × 4 h | 20 |
| comparative example 1 | 550° C. × 6 h | 39.8 | 165 | 950° C. × 1 min | 52 | 450° C. × 2 h | 30 |
| comparative example 2 | — | — | — | 955° C. × 1 min | — | 450° C. × 3 h | 35 |
| comparative example 3 | 450° C. × 8 h | 53.6 | 186 | 955° C. × 1 min | — | 450° C. × 3 h | 35 |
| comparative example 4 | 450° C. × 8 h | 53.6 | 186 | 955° C. × 1 min | — | 500° C. × 6 h | 35 |

TABLE 2-continued

| | manufacturing condition | | | | | | |
|---|---|---|---|---|---|---|---|
| | intermediate annealing | | | | | | |
| | annealing condition | conductivity after annealing (% IACS) | hardness after annealing (HV) | heating condition of solution heat treatment | holding time at 700° C. (sec) | aging condition | finish rolling ratio (%) |
| comparative example 5 | 450° C. × 8 h | 53.6 | 186 | 955° C. × 1 min | — | 475° C. × 8 h | 35 |
| comparative example 6 | — | — | — | — | — | — | — |
| comparative example 7 | 950° C. × 1 h | 14.5 | 86 | 955° C. × 1 min | 52 | 450° C. × 3 h | 35 |
| comparative example 8 | — | — | — | 950° C. × 2 min | — | 500° C. × 3 h | 0 |

Next, samples were picked up from the obtained copper alloy sheets, and a twin boundary density, an area ratio of Cube-orientated grains, an average crystal grain size, conductivity, strength (0.2% proof stress), bending workability, and stress relaxation resistance were examined in the following manner.

After surfaces of the rolled sheets were polished with a #1500 water-resistant paper (emery paper), they were finish-polished by a vibration polishing method in order to prevent a polishing strain in the surfaces, and on each of the surfaces, a distribution chart of CSL (Coincidence Site Lattice boundary) and a crystal grain orientation distribution map (OIM image) were measured by the EBSP method by using a FESEM (Field Emission Scanning Electron Microscope) manufactured by JEOL Ltd. A density (ratio) of Σ3 coincidence site lattice boundaries (corresponding to twin boundaries) was calculated by "sum of lengths of the Σ3 coincidence site lattice boundaries)/(sum of lengths of grain boundaries)×100 (%). Further, from the crystal grain orientation distribution map (OIM image), crystal grains having orientation whose orientation difference from {100} orientation was within 10° were extracted, and an area ratio thereof was found as an area ratio of the Cube orientation.

To measure an average crystal grain size, a JIS H0501 cutting method was used (twin boundaries were excluded), that is, the rolled sheet surface was etched after being polished and the surface was observed with an optical microscope. Conductivity of each of the copper alloy sheets was measured according to a conductivity measurement method of JIS H10505.

As for 0.2% proof stress, three test pieces for LD (rolling direction) tensile test of copper alloy sheets (No. 5 test pieces of JIS Z2241) were extracted from each and a tensile test based on JIS Z2241 was conducted and an average value of the results was found.

Further, in order to evaluate bending workability, three bending test pieces (width 10 mm) whose longitudinal direction was LD (rolling direction) and three bending test pieces (width 10 mm) whose longitudinal direction was TD (direction perpendicular to the rolling direction and a thickness direction) were extracted from the copper alloy sheets of each of the examples, and a 90° W bend test based on JIS H3 110 was conducted on each of the test pieces. Regarding the test pieces having undergone the test, surfaces and cross sections of bent portions were observed with an optical microscope with a magnification of 50×, the minimum bend radius R at which a fracture did not occur was found, and the minimum bend radius R was divided by a thickness t of each of the copper alloy sheets, whereby an R/t value of each of the test pieces for LD and TD was found. Among the three test pieces for LD and the three test pieces for TD, the results of the test pieces with the worst result were adopted.

Further, bend test pieces (width 10 mm) whose longitudinal direction was TD were picked up from the samples of each of the examples and were fixed in an arched state so that surface stress of a longitudinal center portion of each of the test pieces became 80% of 0.2% proof stress. The surface stress (MPa) can be found as $6Et\delta/L_0^2$, where E is an elastic modulus (MPa), t is a thickness (mm) of each sample, and δ is deflection height (mm). From a bending property after the test pieces were kept in the atmosphere at a 150° C. temperature for 1000 hours, a stress relaxation ratio (%) was calculated as $(L_1-L_2)/(L_1-L_0)\times 100$ (%), where $L_0$ is a length of a jig, that is, a horizontal distance (mm) between sample ends fixed during the test, $L_1$ is a sample length (mm) at the start of the test, and $L_2$ is a horizontal distance (mm) between the sample ends after the test.

The results of twin boundary density, area ratio of the Cube orientation crystal grains, average crystal grain size, conductivity, strength (0.2% proof stress), bending workability, and stress relaxation resistance which were examined in the above-described manner are shown in TABLE 3.

Figure 2:
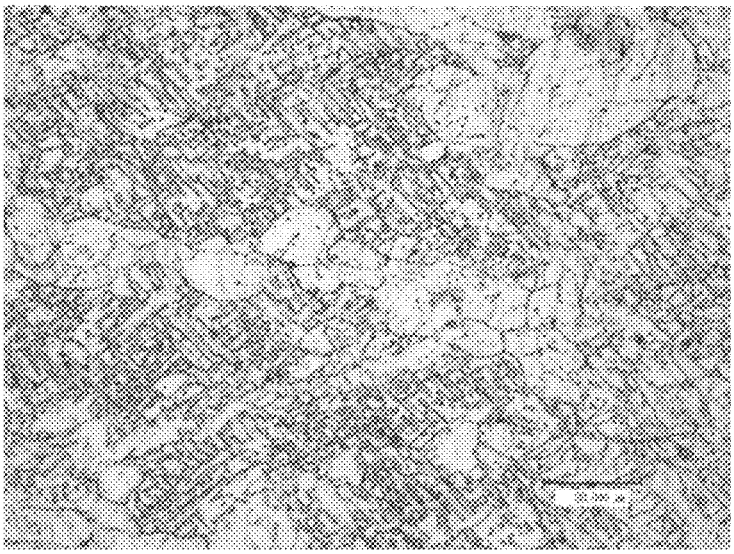
FIG. 2 is an optical microscope texture photograph of a copper alloy sheet of an example 1.
Figure 3:
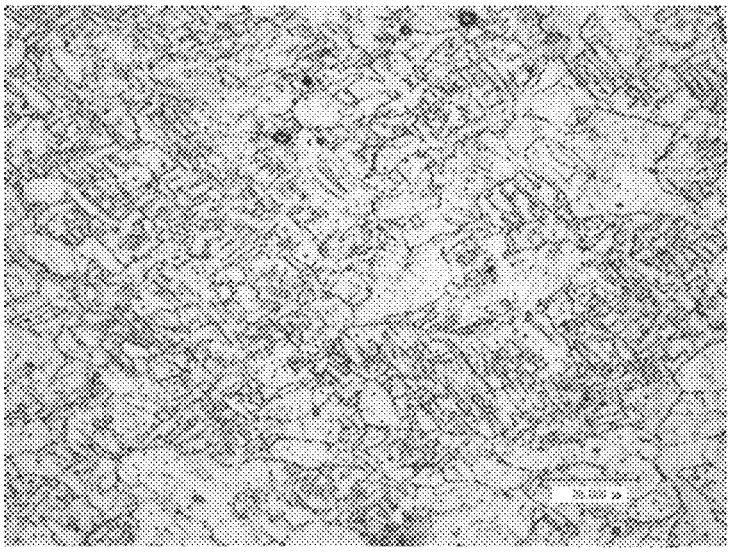
FIG. 3 is an optical microscope texture photograph of a copper alloy sheet of an example 2.

As shown in TABLE 3, the examples 1 to 13 to which the present invention was applied all had 0.2% proof stress of 900 MPa or more, conductivity of 35% IACS or more, a stress relaxation ratio of 5% or less, bending workability with the ratio R/t of the minimum bend radius R and the thickness t being 1.5 or less. Further, as is seen from optical microscope texture photos shown in FIG. 2 and FIG. 3, numerous twins were observed. As a result of measuring twin boundaries, the twin boundary densities of the examples 1, 2 were 73% and 78% respectively.

TABLE 3

| | twin boundary density (%) | area ratio of Cube-orientated grains (%) | average crystal grain size (μm) | property | | | | |
|---|---|---|---|---|---|---|---|---|
| | | | | conductivity (% IACS) | 0.2 proof stress LD (MPa) | bending workability (R/t) | | stress relaxation ratio TD (%) |
| | | | | | | Good way | Bad way | |
| example 1 | 73 | 33 | 14 | 38.6 | 937 | 0.0 | 1.0 | 3.8 |
| example 2 | 78 | 35 | 12 | 37.4 | 972 | 0.3 | 1.3 | 3.4 |
| example 3 | 68 | 26 | 10 | 44.4 | 921 | 0.0 | 0.7 | 4.2 |
| example 4 | 68 | 28 | 8 | 39.7 | 952 | 0.0 | 1.0 | 4.4 |

TABLE 3-continued

| | twin boundary density (%) | area ratio of Cube-orientated grains (%) | average crystal grain size (μm) | property: conductivity (% IACS) | property: 0.2 proof stress LD (MPa) | property: bending workability (R/t) Good way | property: bending workability (R/t) Bad way | property: stress relaxation ratio TD (%) |
|---|---|---|---|---|---|---|---|---|
| example 5 | 65 | 25 | 11 | 38.6 | 922 | 0.0 | 0.7 | 3.7 |
| example 6 | 77 | 23 | 13 | 35.2 | 986 | 1.0 | 1.5 | 3.5 |
| example 7 | 84 | 39 | 17 | 36.4 | 958 | 0.3 | 1.0 | 3.3 |
| example 8 | 80 | 36 | 12 | 40.9 | 945 | 0.0 | 0.3 | 3.7 |
| example 9 | 79 | 30 | 11 | 43.9 | 902 | 0.0 | 0.7 | 3.1 |
| example 10 | 75 | 28 | 20 | 45.0 | 934 | 0.0 | 1.0 | 4.1 |
| example 11 | 71 | 34 | 13 | 37.7 | 963 | 0.3 | 1.3 | 3.5 |
| example 12 | 44 | 21 | 9 | 40.2 | 925 | 0.0 | 1.3 | 4.9 |
| example 13 | 56 | 23 | 8 | 42.6 | 916 | 0.0 | 1.0 | 4.8 |
| comparative example 1 | 31 | 8 | 14 | 32.4 | 896 | 1.0 | 3.0 | 5.6 |
| camparative example 2 | 12 | 6 | 12 | 38.4 | 943 | 0.5 | 4.0 | 6.4 |
| comparative example 3 | 22 | 12 | 11 | 28.6 | 782 | 0.0 | 3.0 | 5.8 |
| comparative example 4 | 22 | 12 | 11 | 41.6 | 826 | 1.0 | 3.0 | 5.7 |
| comparative example 5 | 22 | 12 | 11 | 44.6 | 856 | 1.0 | 3.0 | 5.4 |
| comparative example 6 | — | — | — | — | — | — | — | — |
| comparative example 7 | 16 | 10 | 10 | 36.2 | 951 | 1.0 | 4.0 | 6.6 |
| comparative example 8 | 12 | 12 | 10 | 45.0 | 918 | 0.0 | 1.0 | 7.4 |

Further, as shown in TABLES 1 to 3, sheets of comparative examples 1 to 8 falling out of the range of the present invention were manufactured, and properties of the respective sheets were examined in the same manner as the examples 1 to 13.

Figure 4:
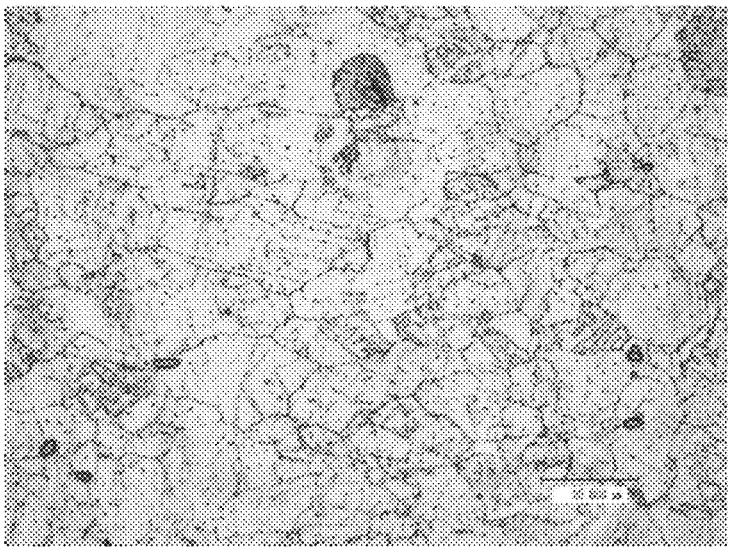
FIG. 4 is an optical microscope texture photograph of a copper alloy sheet of a comparative example 1.

The comparative example 1 had the composition with substantially the same amounts of Ni and Co as those of the example 1, an excessive amount of Si, and (Ni+Co)/Si=3.8, and was manufactured under the same manufacturing condition as that of the example 1. The obtained copper alloy sheet was low in conductivity after the intermediate annealing and had a high hardness value. As a result, the number of twins was small, and a twin boundary density and an area ratio of Cube-orientated grains were finally both low as shown in FIG. 4. Further, due to the excessive Si amount, an amount of precipitates was small during the aging and as a result, conductivity, 0.2% proof stress, bending workability, and stress relaxation resistance were all slightly low.

The comparative examples 2 to 5 are copper alloy sheets having the same composition as that of the example 2, and manufactured by a conventional manufacturing method without being subjected to the intermediate annealing (comparative example 2) or without being subjected to the temperature maintaining step at 700° C. in the course of the cooling of the solution heat treatment step (comparative examples 3 to 5).

Figure 5:
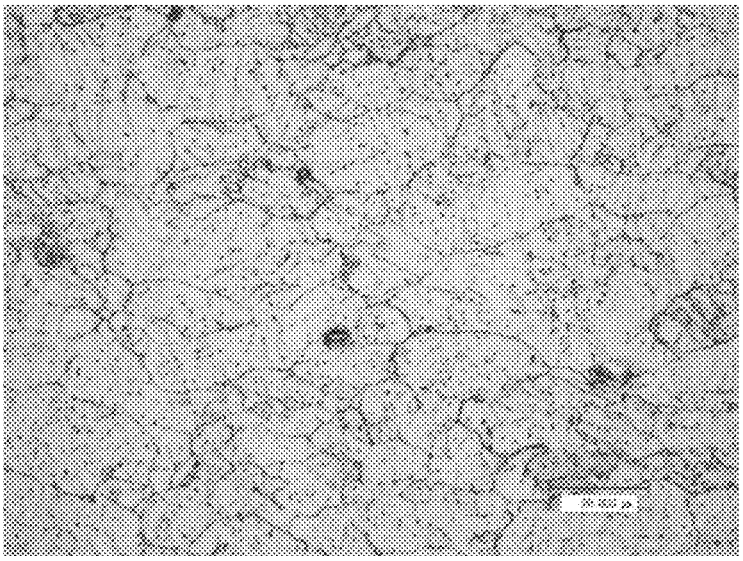
FIG. 5 is an optical microscope texture photograph of a copper alloy sheet of a comparative example 2.

A manufacturing condition of the comparative example 2 was the same as that of the example 2 except that the intermediate annealing step was not performed, and as shown in FIG. 5, the number of twins was small and a twin boundary density and an area ratio of Cube oriented-grains were finally both low. Further, bending workability and stress relaxation resistance were low.

A manufacturing condition of the comparative example 3 was the same as that of the example 2 except that the temperature at the time of the intermediate annealing step was low and the temperature maintaining step at 700° C. in the course of the cooling in the solution heat treatment step was not performed, and a twin boundary density and an area ratio of Cube oriented-grains were finally both low. Since the temperature maintaining step at 700° C. in the solution heat treatment step was not performed, a Co—Si based compound was not sufficiently precipitated, and conductivity, 0.2% proof stress, bending workability, and stress relaxation resistance were all low.

The comparative example 4 was manufactured under the same manufacturing condition as that of the comparative example 3 except that its aging conditions were six hours and 500° C. which is thought to be the optimum aging temperature of a Co—Si based compound. Since an Ni—Si based precipitate of the obtained copper alloy sheet was already coarse, conductivity and 0.2% proof stress were as a result higher than those of the comparative example 3, but its property was far poorer compared with those of the copper alloys of the examples to which the present invention was applied.

The comparative example 5 was manufactured under the same manufacturing condition as that of the comparative example 3 except that its aging conditions were eight hours and 475° C. which is thought to be an intermediate temperature between the optimum aging temperatures for a Co—Si based precipitate and an Ni—Si based compound. In the obtained copper alloy sheet, the balance between conductivity and 0.2% proof stress was more greatly improved than in the comparative examples 3 and 4, but properties other than conductivity were far poorer than those of the example 2 with the same composition.

The comparative example 6 had the composition containing 1.46 mass % N, 2.46 mass % Co, and 0.82 mass % Si, with the balance being composed of Cu and unavoidable impurities. This raw material was melted and cast by using a vertical semi-continuous casting machine, whereby a cast slab was obtained. Since an addition amount of Co was over 2.0 mass % and was thus too large, coarse crystallized substances formed during the casting process did not solid-dissolve during the heating prior to the hot rolling and a great fracture occurred during the hot rolling, and therefore, steps thereafter were abandoned.

The comparative example 7 had the same composition as that of the example 2, and the copper alloy sheet was manufactured under the same manufacturing condition as that of the example 2 except that its intermediate annealing condition was different. Conductivity and 0.2 proof stress were good, but since a temperature condition of the intermediate annealing was too high (the condition in the aforesaid International Publication WO2009-123140), a twin boundary density and an area ratio of Cube oriented-grains were as a result both low, and bending workability and stress relaxation resistance in BW were both poor.

The comparative example 8 is the case where the intermediate annealing is not performed and the 700° C. temperature maintaining step is not performed in the course of the cooling of the solution heat treatment step and is a copper alloy sheet manufactured by the conventional manufacturing method. In the comparative example 8, in order to prevent a precipitate from becoming coarse during the hot rolling step, the hot rolling finish temperature was set to 850° C. or higher (while the sample was held in a 900° C. furnace for 5 min. in each rolling pass), and thereafter it was quenched at 15° C./s or more. Further, in order to prevent deterioration in bending workability, the finish rolling after the aging was not performed and instead, cold rolling with a 50% rolling ratio was performed before the aging (after the solution heat treatment). It was manufactured under the same manufacturing condition as that of the example 1 except for the manufacturing condition shown in TABLE 2. As a result, conductivity, 0.2% proof stress, and bending workability were good, but the twin boundary density was low and stress relaxation resistance was poor.

As described above, the comparative examples 1 to 8 cannot have the performance of the copper alloy sheet of the present invention because their compositions or manufacturing conditions deviate from the range of the present invention, and it has been found out that all the comparative examples are far inferior in property, compared with the examples 1 to 13 to which the present invention is applied.

The present invention is applicable as a copper alloy sheet having high conductivity, high strength, and excellent bending workability and stress relaxation resistance at the same time and as a manufacturing method of the copper alloy sheet.

What is claimed is:

1. A manufacturing method of a copper alloy sheet comprising:

a melting/casting step of melting and casting a raw material of a copper alloy having a composition consisting of 1.0 mass% to 3.5 mass% Ni, 0.5 mass% to 2.0 mass% Co, and 0.3 mass% to 1.5 mass% Si with a balance being composed of Cu and an unavoidable impurity;

a hot rolling step of performing hot rolling after said melting/casting step;

a first cold rolling step of performing cold rolling after said hot rolling step;

an intermediate annealing step of performing heat treatment at a heating temperature of 500° C. to 650° C. after said first cold rolling step;

a second cold rolling step of performing cold rolling with a rolling ratio of 70% or more after said intermediate annealing step;

a solution heat treatment step of performing solution heat treatment after said second cold rolling step; and an aging step of performing aging at 400° C. to 500° C. after said solution heat treatment step, wherein said solution heat treatment step includes: a heating step at 800° C. to 1020° C.; a first quenching step of performing quenching to a temperature range of 550° C. to 750° C. at a cooling speed of 10° C./s or more; a temperature maintaining step of maintaining the 550° C. to 750° C. temperature for 10 seconds to 600 seconds; and a second quenching step of performing quenching to 300° C. or lower after said temperature maintaining step;

in said intermediate annealing step, said heat treatment is continued for 0.1 hours to 20 hours to make conductivity satisfy 40% IACS or more and make Vickers hardness satisfy HV150 or less after said intermediate annealing step.

2. The manufacturing method of the copper alloy sheet according to claim 1, wherein an average size of crystal grains after said solution heat treatment step is 3 μm to 60 μm.

3. The manufacturing method of the copper alloy sheet according to claim 1, further comprising:

a finish cold rolling step of performing cold rolling with a 10% to 80% rolling ratio after said aging step.

4. The manufacturing method of the copper alloy sheet according to claim 3, further comprising:

a low-temperature annealing step of performing heat treatment at 150° C. to 550° C. after said finish cold rolling step.

5. A manufacturing method of a copper alloy sheet comprising:

a melting/casting step of melting and casting a raw material of a copper alloy having a composition consisting of 1.0 mass % to 3.5 mass % Ni, 0.5 mass % to 2.0 mass % Co, and 0.3 mass % to 1.5 mass % Si, at least one of Fe, Cr, Mg, Ti, V, Zr, Sn, Zn, Al, B, P, Ag, Be, and misch metal of 2 mass % or less with a balance being composed of Cu and an unavoidable impurity;

a hot rolling step of performing hot rolling after said melting/casting step;

a first cold rolling step of performing cold rolling after said hot rolling step;

an intermediate annealing step of performing heat treatment at a heating temperature of 500° C. to 650° C. after said first cold rolling step;

a second cold rolling step of performing cold rolling with a rolling ratio of 70% or more after said intermediate annealing step;

a solution heat treatment step of performing solution heat treatment after said second cold rolling step; and an aging step of performing aging at 400° C. to 500° C. after said solution heat treatment step, wherein said solution heat treatment step includes: a heating step at 800° C. to 1020° C.; a first quenching step of performing quenching to a temperature range of 550° C. to 750° C. at a cooling speed of 10° C./s or more a temperature maintaining step of maintaining the 550° C. to 750° C. temperature for 10 seconds to 600 seconds; and a second quenching step of performing quenching to 300° C. or lower after said temperature maintaining step;

in said intermediate annealing step, said heat treatment is continued for 0.1 hours to 20 hours to make conductivity satisfy 40% IACS or more and make Vickers hardness satisfy HV150 or less after said intermediate annealing step, and a mass ratio of Sn is 0.05 mass % or less.

6. The manufacturing method of the copper alloy sheet according to claim 1, wherein, in the second quenching step, an average cooling speed from the 550° C. to 750° C. temperature down to 300° C. or lower is 50° C./s or more.

* * * * *